US007007621B1

(12) United States Patent
Bootes

(10) Patent No.: US 7,007,621 B1
(45) Date of Patent: Mar. 7, 2006

(54) BRAKING SYSTEM FOR A PERSONAL WATERCRAFT

(76) Inventor: Todd Bootes, P.O. Box 60564, Fort Myers, FL (US) 33906

( * ) Notice: Subject to any disclaimer, the term of this patent is extended or adjusted under 35 U.S.C. 154(b) by 0 days.

(21) Appl. No.: 10/966,050

(22) Filed: Oct. 15, 2004

(51) Int. Cl.
*B63H 25/48* (2006.01)

(52) U.S. Cl. ..... 114/145 R; 440/42

(58) Field of Classification Search ..... 114/145 R, 114/145 A, 285, 286; 440/42
See application file for complete search history.

(56) References Cited

U.S. PATENT DOCUMENTS 1,195,149 A * 8/1916 Ollard ..... 114/145 R
1,799,455 A * 4/1931 Cavert ..... 114/145 R
1,879,432 A * 9/1932 Norton ..... 244/112
1,879,547 A * 9/1932 Semmes ..... 244/112
2,914,019 A * 11/1959 Miller ..... 415/8
2,994,290 A * 8/1961 Merchant ..... 114/145 R
3,763,812 A * 10/1973 Rowe ..... 114/145 A
4,776,295 A * 10/1988 Kline et al. ..... 114/144 R
5,092,260 A * 3/1992 Mardikian ..... 114/285
5,193,478 A * 3/1993 Mardikian ..... 114/285
D366,644 S * 1/1996 Morrow ..... D12/317
6,524,146 B1 * 2/2003 Spade et al. ..... 440/41
6,691,634 B1 * 2/2004 Fritchle ..... 114/145 R

* cited by examiner

*Primary Examiner*—Jesus D. Sotelo
(74) *Attorney, Agent, or Firm*—William E. Noonan

(57) ABSTRACT

A braking system for a personal watercraft includes at least one brake plate for mounting to the transom of a personal watercraft such that the jet nozzle of the watercraft is directionally adjustable independently of the braking system. The brake plate is alternatable between a nonbraking condition wherein the plate is retracted against the transom and is held completely above a lower edge of the transom, and a braking condition where the brake plate extends beyond the lower edge of the transom. A hand-controlled actuator assembly selectively alternates the brake plate between the braking and nonbraking conditions.

17 Claims, 5 Drawing Sheets

BRAKING SYSTEM FOR A PERSONAL WATERCRAFT

FIELD OF THE INVENTION

This invention relates to a braking system for a personal watercraft and, more particularly, to a braking system that operates independently of the principal steering system of the personal watercraft.

BACKGROUND OF THE INVENTION

Personal watercraft have become increasingly popular in recent years. At the same time, the risk of dangerous accidents involving such watercraft has likewise increased. Personal watercraft (PWC) are notoriously difficult to brake and control. In most cases, control or steering is achieved by the jet nozzle which expels pressurized water to propel the PWC. Operator controls allow the user to direct the jet nozzle as needed to accomplish desired turning or steering.

Currently, no satisfactory means are provided for braking the PWC. Auxiliary braking mechanisms are rarely, if ever, utilized. Instead, the throttle must be operated to reduce propulsion so that the PWC will gradually slow. This technique is far from satisfactory. For one thing, when the PWC is operating at a high speed, it can take too long for the vessel to slow to a stop. When the PWC is operating at a speed of 60 mph, for example, it can take up to 300 feet to achieve a complete stop. This obviously subjects the PWC and its rider(s) to the risk of a deadly collision with objects in the water that are too close to avoid. This problem is complicated because most personal watercraft are able to properly steer only when operated under full throttle. When the speed is reduced for braking, control is similarly reduced.

Prior attempts to achieve improved PWC braking have been generally unsuccessful. Reversing operation of the jet nozzle puts enormous and potentially damaging strain upon the nozzle. Fritchle, U.S. Pat. No. 6,691,634 discusses the problems associated with conventional PWC braking systems in considerable detail. That reference discloses a hand-operated mechanism for both controlling and braking operation of the PWC. A pair of braking paddles are mounted about the jet nozzle, which has no capability for directional adjustment. The paddles perform all of the steering, as well as the braking for the PWC. This ignores the fact that most personal watercraft employ a directionally adjustable nozzle and do not require such paddles for steering.

SUMMARY OF THE INVENTION

It is therefore an object of the present invention to provide a braking system for a personal watercraft (PWC) which enables braking of the PWC to be performed quickly, safely and reliably.

It is a further object of this invention to provide a PWC braking system that allows the operator of the PWC to brake the PWC quickly enough to avoid dangerous or risky situations, and especially damaging and potentially deadly collisions.

It is a further object of this invention to provide a PWC braking system that operates wholly independently of the vessel's steering system so that improved, custom braking and control are achieved.

It is a further object of this invention to provide a PWC braking system that allows the PWC to be effectively braked without having to reduce propulsion and therefore PWC control.

It is a further object of this invention to provide a PWC braking system that avoids placing undue forces and stress upon the jet nozzle of the PWC.

It is a further object of this invention to provide a PWC braking system that significantly improves PWC operating safety.

This invention features a braking system for a personal watercraft (PWC), which PWC includes a hull having a transom located proximate the stern thereof and a jet nozzle that directs propulsive water flow rearwardly of the transom to drive the watercraft. The nozzle is directionally adjustable by operator controls independently of the braking system for steering the watercraft. The braking system includes at least one brake plate for mounting to the transom such that the nozzle is directionally adjustable independently thereof. The brake plate is alternatable between a nonbraking condition wherein the plate is retracted against the transom and held completely above a lower edge of the transom and a braking condition wherein the braking plate extends beyond the lower edge of the transom. There is a hand-controlled actuator assembly for selectively alternating the brake plate between the nonbraking and braking conditions.

In a preferred embodiment, a pair of brake plates are mounted to the transom on respective sides of the jet nozzle. The actuator may include at least one hand-controlled lever. An actuator cable assembly may be responsively interconnected to the hand control lever and a linkage assembly may interconnect the cable assembly and each brake plate for driving the plate into the braking condition when the hand-controlled lever is operated. Each brake plate may be mounted for sliding vertically in a respective support track that is securable to the transom. Each plate may include a guide slot and the linkage may include a bearing movably interengaging the slot. A fulcrum component may carry the bearing. The fulcrum component may be pivotally mounted to the track and biased by a spring to pull the plate retractably into the nonbraking condition in the track. The linkage may further include an actuator bar for interconnecting the fulcrum component and the cable. The bar is longitudinally driven in response to operation of the hand-controlled lever to drive the fulcrum component pivotally against the spring and urge the plate to slide within the track into an extended braking condition therein. A single actuator bar may interconnect the fulcrum component associated with the first one of the brake plates and a distinct fulcrum component associated with the other brake plate. The bar may be driven longitudinally by the cable in response to operation of the lever for pivotally pulling the first fulcrum component and pivotally pushing the other fulcrum component to urge the plates to slide into the extended braking condition in the respective tracks.

DETAILED DESCRIPTION OF PREFERRED EMBODIMENTS

Other objects, features and advantages will occur from the following description of a preferred embodiment and the accompanying drawings, in which.

Figure 1:
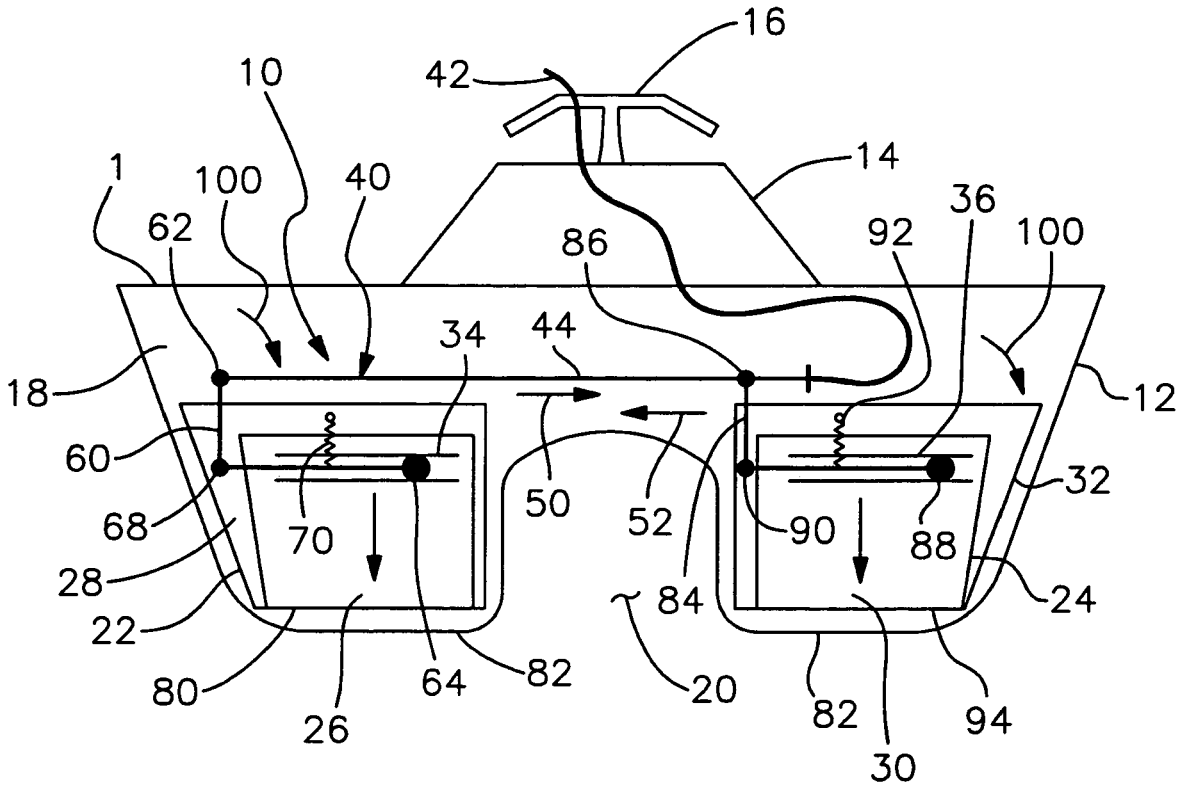
FIG. 1 is a schematic view of a personal watercraft (PWC) employing a braking system in accordance with this invention.

There is shown in FIG. 1, a personal watercraft (PWC) 1 that is equipped with a braking system 10 in accordance with this invention. It should be understood the braking system may be employed on virtually any make and model of personal watercraft. PWC 1 includes a standard hull 12 with a conventional operating console 14 mounted thereon. A control handle bar assembly 16 is mounted for operator access in a manner that will be known to persons skilled in the art. The stern of hull 12 includes a transom 18. A central opening 20 formed in the transom accommodates a conventional jet nozzle (not shown in FIG. 1 but see FIG. 2). The jet nozzle is directionally adjustable and operates to propel water rearwardly from PWC 1. This propels the personal watercraft forwardly in a standard manner.

Braking system 10 includes a pair of retractable braking mechanisms 22 and 24 that are secured to transom 18 on respective sides of jet nozzle opening 20. Brake mechanism 22 includes a generally flat brake plate 26 that is mounted for vertical sliding within a support track 28. Similarly, brake device 24 includes a flat brake plate 30 that is mounted for vertically sliding within a support track 32. Plate 26 includes a horizontal guide 34, which may comprise a slot, channel, race or track in plate 26. Likewise, plate 30 includes a horizontal guide 36. The structure and operation of guides 34 and 36 are described more fully below.

Brake plates 26 and 30 are operatively engaged and controlled by an actuator mechanism 40. More particularly, a braking cable 42 is interconnected between hand-operated brake levers (not shown in FIG. 1), that are mounted on control handle 16, and an elongate actuator bar 44. As is described more fully below, the hand levers and brake cable resemble analogous components in a typical hand-braking system for a bicycle. In alternative embodiments, alternative types of brake actuators such as a hydraulic system or a solenoid or other type of electronic control system may be employed.

Brake cable 42 is operatively connected to actuator bar 44 such that when the hand-controlled levers are engaged, the cable 42 pulls bar 44 in the direction of arrow 50. When the hand-controlled levers are released, bar 44 is returned in the direction of arrow 52. This return movement is accomplished by springs, which are described more fully below.

Bar 44 is part of a linkage that interconnects braking cable 42 and each of the brake devices 22 and 24. In particular, the left-hand end of bar 44 is interconnected to brake plate 26 by a generally L-shaped fulcrum component 60. A first pivot element 62 interconnects fulcrum component 60 to the left-hand end of bar 44. The opposite end of the fulcrum component carries a roller bearing 64 that is movably interengaged with guide 34. The fulcrum component 60 is pivotally mounted to track 28 by a pivot element 68. A spring 70 interconnects the horizontal leg of fulcrum component 60 with an upper portion of support track 28. The spring pulls upwardly on this horizontal leg of the fulcrum component, which causes roller bearing 64 to interengage guide 34 such that brake plate 26 is maintained in a retracted condition within support track 22. As shown in FIG. 1, the lower edge 80 of the brake plate is located above the lowermost edge 82 of transom 18.

Actuator 40 is operatively interengaged with brake plate 30 in an analogous manner. A second L-shaped fulcrum component 84 is connected by a pivot element 86 to actuator bar 44. The opposite end of fulcrum component 84 carries a roller bearing 88 that movably interengages guide 36 in brake plate 30. Fulcrum component 84 is pivotally mounted by pin 90 to support track 32 and the horizontal leg of fulcrum component 84 is biased upwardly into a horizontal position by compression spring 92. This causes brake plate 30 to be held in the retracted condition shown in FIG. 1 with its lower edge 94 above the lower edge 82 of transom 18.

To deploy the brakes, the operator squeezes the hand-controlled levers on handle 16. This causes brake cable 42 to pull actuator bar 44 to the right as indicated by arrow 50. This, in turn, causes fulcrum components 60 and 84 to pivot in a generally clockwise direction as indicated by arrows 100. The roller bearings 64 and 88 interengage and move to the left in respective guides 34 and 36. This causes the brake plates 26 and 30 to be extended downwardly beyond the lower edge of transom 18. As a result, the extended brake plates create resistance within the water so that the PWC is promptly braked.

Figure 2:
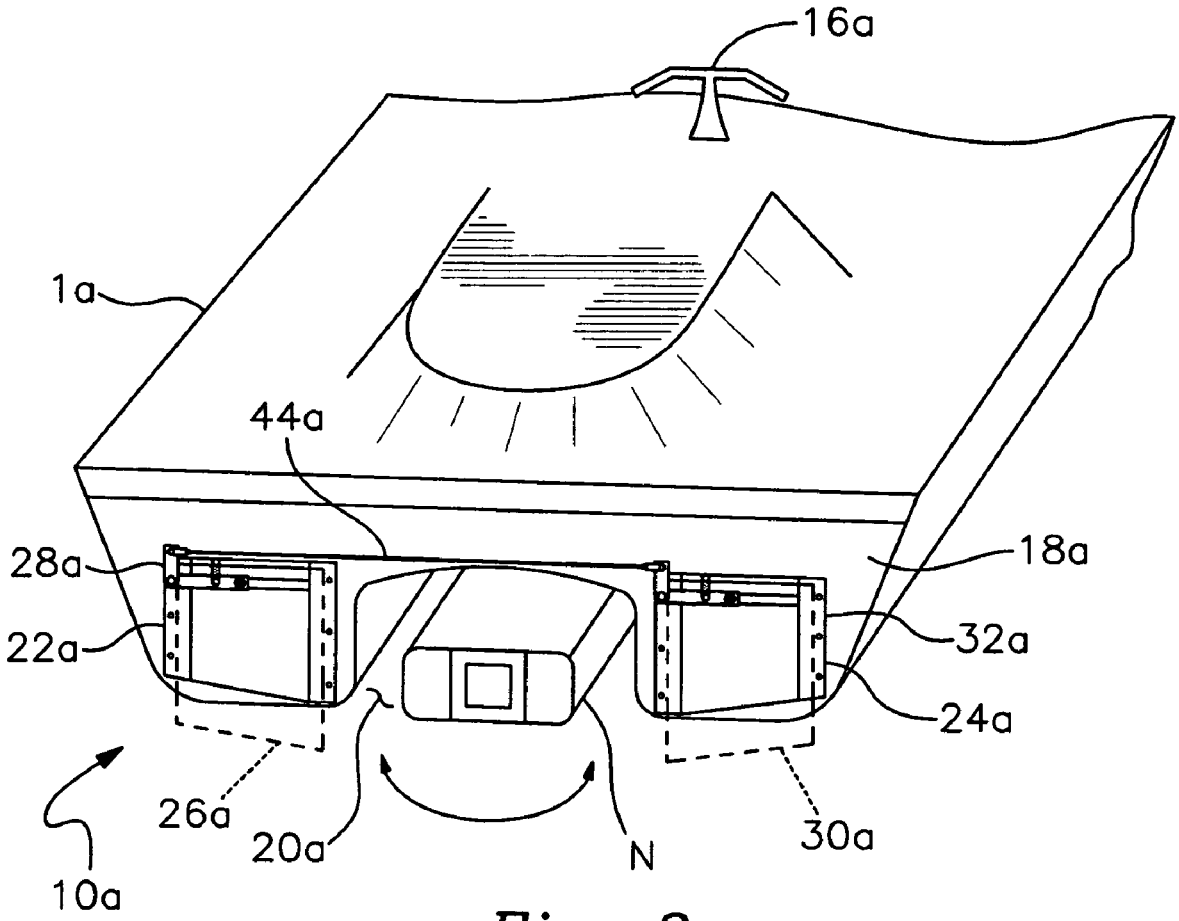
FIG. 2 is a perspective view of the stern of a PWC with a preferred version of the braking system of this invention mounted to the transom.

A particularly preferred version of the braking system 10*a* is depicted in FIGS. 2–5. FIG. 2 specifically illustrates the stern of PWC 1*a* wherein brake devices 22*a* and 24*a* are mounted on transom 18*a*. A jet nozzle N is mounted in a conventional manner such that it points rearwardly through opening 20*a* located between brake devices 22*a* and 24*a*. Jet nozzle N is directionally adjustable in a known manner such as by turning control handle 16*a*. A pair of hand-controlled levers 15*a*, 17*a*, FIG. 3, which are analogous to the brake control levers used in racing bicycles are mounted on respective sides of handlebar 16*a*. A braking cable 42*a* is operatively connected to braking levers 15*a* and 16*a* in a manner that will be known to persons skilled in the art of cable actuator braking systems. As previously indicated, alternative means of brake actuation may include hydraulics and electronics (e.g. solenoids). Cable 42*a* is typically mounted and run through the hull of PWC 1*a*. Once again, the particular manner of mounting this cable within the hull may be varied and does not constitute a feature of this invention. Likewise, the manner for mounting and turning jet nozzle N constitutes a standard construction will be known to persons skilled in the art.

Figure 4:
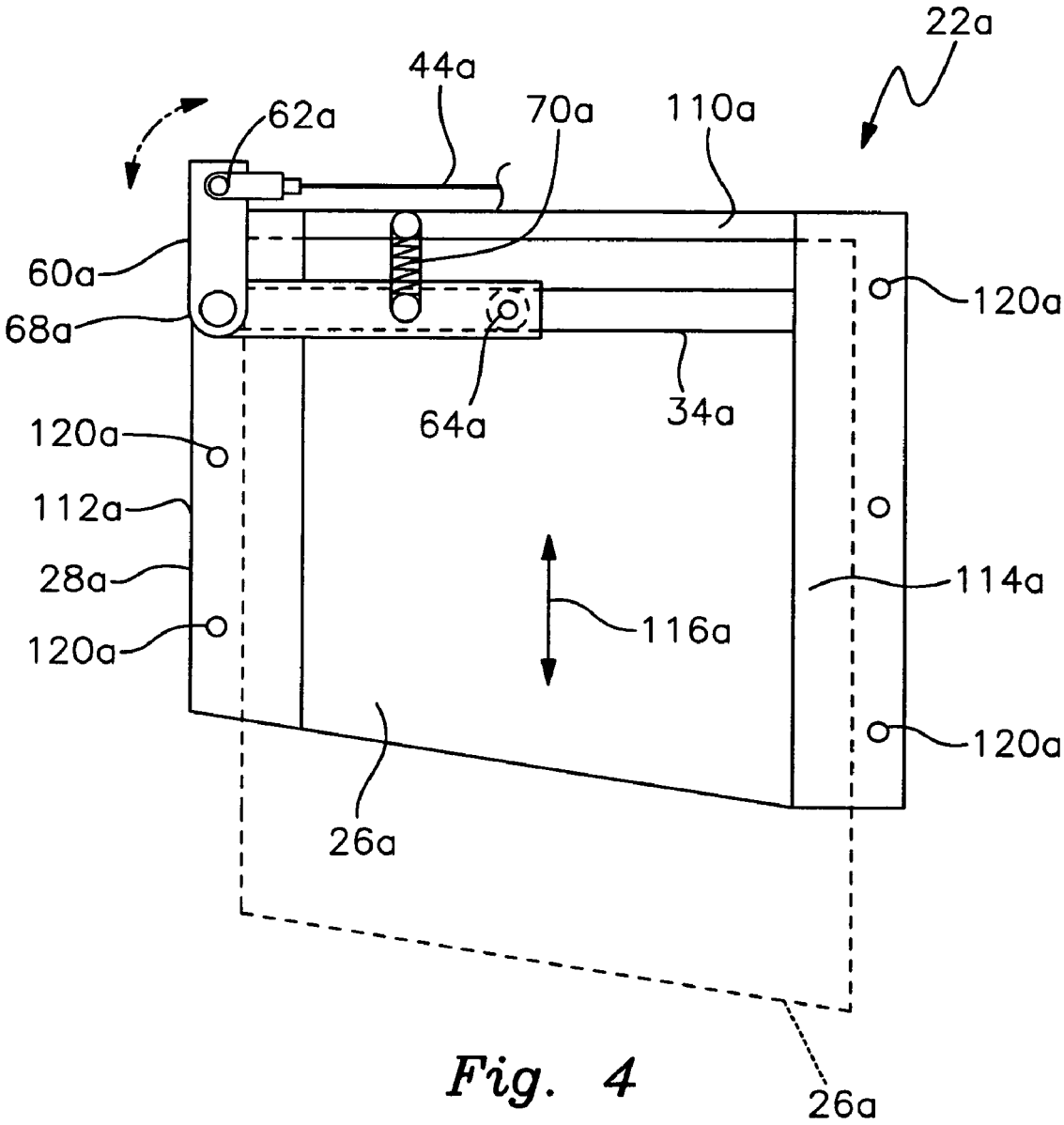
FIG. 4 is a front elevational view of the left-hand brake plate as mounted in the support track and interengaged by respective linkage.

As illustrated in FIGS. 2 and 4, left-hand brake device 22*a* includes a brake plate 26*a* that is slidably mounted within a support track 28*a*. The support track includes an underlying base panel 110*a* that is flushly and slidably interengaged by brake plate 26*a*. The support track includes a pair of inwardly turned lips or flanges 112*a* and 114*a* that define vertical channels along the respective sides of support track 28*a*. As best shown in FIG. 4, the vertical sides of brake plate 26*a* fit within these respective side channels of support track 28*a* such that the brake plate is alternately slidable in upward and downward directions within the support track as indicated by doubleheaded arrow 116*a*. The support track itself is secured to transom 18*a* by bolts 120*a* or analogous means of attachment.

Figure 5:
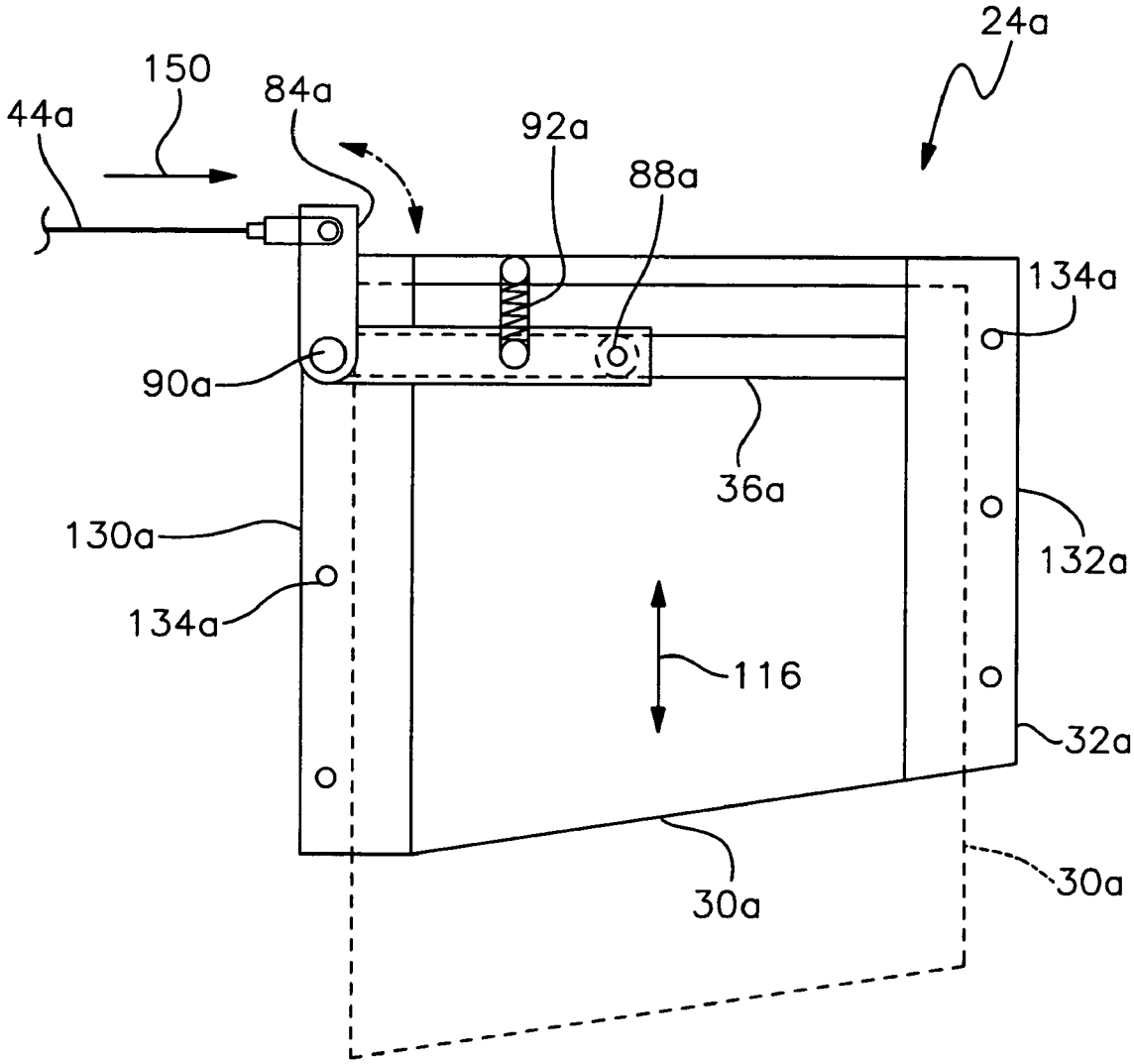
FIG. 5 is a view similar to FIG. 4 of the right-hand brake plate as well as its slide track and associated linkage.

Brake device 24*a*, FIGS. 2 and 5, is constructed in a similar manner. Specifically, brake plate 30*a* is slidably mounted in support track 32*a*. The support track includes an underlying base panel 111*a* and inwardly turned side lips or flanges 130*a* and 132*a* that define vertical channels for receiving respective side edges of brake plate 30*a*. The support track 32*a* is itself secured to the transom by bolts 134*a* or analogous means of attachment. Brake plate 30*a* is therefore slidable within track 32*a* as indicated by double-headed arrow 116*a*. The brake plate slides between the retracted condition where it generally conforms with and sits entirely within track 32*a* and the extended condition shown in phantom.

Figure 3:
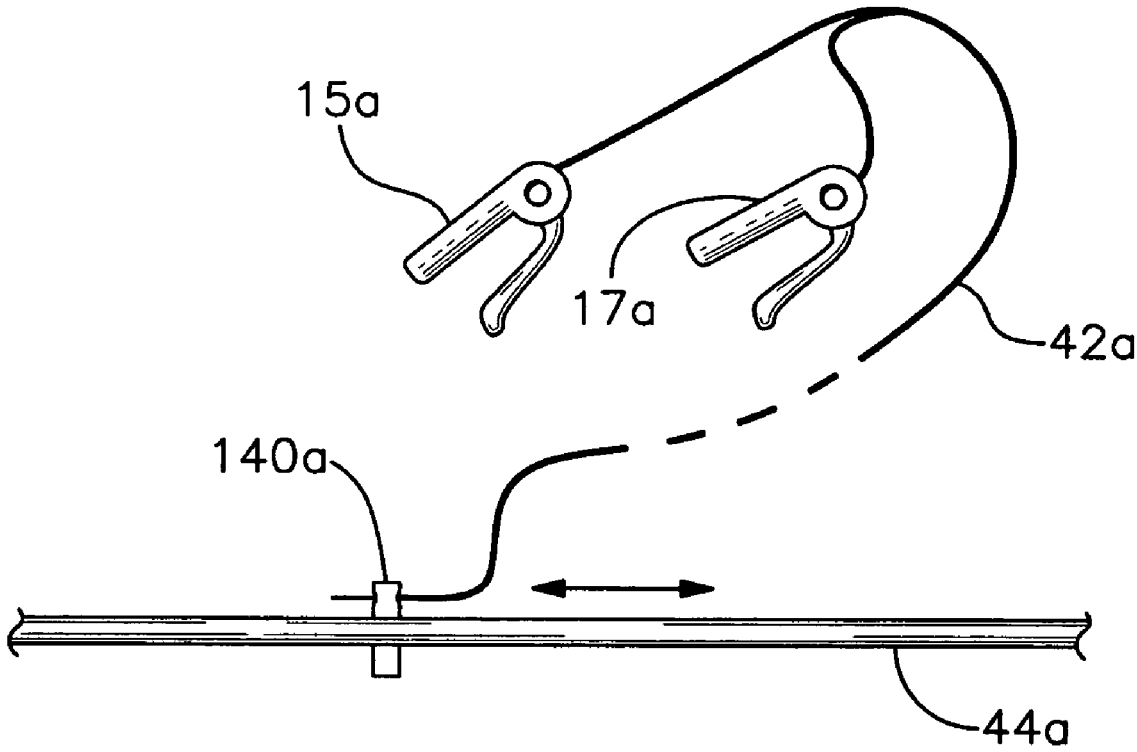
FIG. 3 is a simplified view of the hand-operated control levers, the actuator cable and the actuator bar.

The particular preferred actuator mechanism employed by the braking system is best understood by referring to FIGS. 3–5. As previously described, a braking cable 42*a* is operated in a conventional manner by hand-controlled levers 15*a* and 17*a*. The distal end of brake cable 42*a* is secured by a pin, rivet or welding 140*a* to elongate actuator bar 144*a*. The left-hand end of bar 44*a* is interconnected through appropriate linkage to brake plate 26*a*. More particular, a pivot mechanism 62*a* interconnects the distal end of bar 44*a* to the upper vertical leg of L-shaped fulcrum component 60*a*. The fulcrum component is pivotally connected to support track 28*a* by a pivot 68*a*. Roller bearing 64*a* is rotatably mounted to the horizontal leg of the fulcrum component. The roller bearing is movably interengaged with an elongate horizontal guide slot 34*a* formed in brake plate 26*a*. Helical compression spring 70*a* interconnects the horizontal leg of fulcrum component 60*a* and the base plate 110*a* of support track 28*a*. As previously described, this pulls the horizontal leg of the fulcrum component upwardly with the fulcrum component pivoting about pivot 68*a*. As a result, bearing 64 interengages slot 34*a* such that plate 26*a* is biased into a retracted, nonbraking condition in track 28*a*.

By the same token, the opposite right-hand end of actuator bar 44*a* is pivotally secured to a second fulcrum component 84*a* in the manner shown in FIG. 5. This fulcrum component is itself connected by pivot 90*a* to the lip 130*a* of support track 30*a*. A second roller bearing 88*a* is movably interengaged with horizontal guide slot 36*a* formed in brake plate 30*a*. Helical compression spring 92*a* biases the fulcrum component such that it holds brake plate 30*a* in a retracted condition within support track 32*a*.

To operate braking system 10*a*, the operator riding PWC 1*a* squeezes the hand-controlled levers 15*a* and 17*a* to the degree desired or needed. This drives cable 42*a*, which in turn pulls actuator rod 44*a* to the right as seen in FIG. 3. When the actuator rod is pulled in this direction, fulcrum component 68*a*, FIG. 4, is pivoted clockwise about pivot 60*a*. The horizontal leg of fulcrum component 68*a* is pivoted downwardly and pulled against spring 70*a*. Roller bearing 64*a* moves to the left within slotted channel 34*a*. As a result, the roller bearing urges brake plate 26*a* downwardly into the extended position shown in phantom in FIG. 4.

By the same token, as seen in FIG. 5, actuator rod 44*a* moves to the right as indicated by arrow 150*a*. This causes fulcrum component 84*a* to pivot in a clockwise direction about 90*a*. The horizontal leg of fulcrum component 84*a* pivots downwardly against the bias of spring 92*a*. Roller bearing 88*a* rolls to the left within slotted guide 36*a* of brake plate 30*a*. The roller bearing urges the brake plate to extend downwardly to the condition indicated by brake plate 30*a* in phantom.

Operation of the control levers 15*a* and 17*a* causes brake plates 26*a* and 30*a* to extend simultaneously below their respective support tracks. As shown in FIG. 2, with the brake plates in this deployed, extended condition, they interfere with the water through which PWC 1*a* is traveling. This creates a drag that causes virtually immediate slowing (braking) of the personal watercraft. Nonetheless, safe control is able to be maintained. The operators is not required to throttle-down or otherwise reduce power. This allows the operator to continue to be able to directionally adjust jet nozzle N so that the personal watercraft may be appropriately steered. Controller steering and braking are thereby achieved independently of one another. The user is therefore able to better avoid sudden dangers and the risk of a potentially disastrous collision. Such a capability is not provided by the prior art.

To release the brake, the operator simply reduces hand-pressure on the control levers 15*a* and 17*a*. The helical compression springs 70*a* and 92*a* pull upwardly on respective fulcrum components 60*a* and 84*a*. This causes the fulcrum components to rotate about respective pivots 68*a* and 90*a* in a counterclockwise direction. The respective roller bearings 64*a* and 88*a* travel to the right in respective guide slots 34*a* and 36*a*. As a result, the fulcrum component pulls the brake plates 26*a* and 30*a* upwardly within their respective support tracks 28*a* and 32*a*. The brake plates are pulled completely above the lower edge of the transom and braking is released. By controlling the amount of pressure that is applied to control levers 15*a* and 17*a*, the degree of extension and retraction of the brake plates and therefore the degree of braking may be adjusted as needed. The personal watercraft thereby may be slowed as necessary to achieve safe operation and to avoid potentially disastrous collisions.

It should be understood that various modifications of the braking system may be made within the scope of this invention. For example, other numbers of braking devices comprising brake plates and support tracks may be utilized. The brake plates and support tracks may have alternative configurations and the brake plates may be mounted pivotally to the transom. In order to achieve the benefits of this invention, it is critical that the braking system be mounted to the transom and operable independently of the jet nozzle.

"Throttling down" on the jet nozzle, with an attendant reduction of control, is not required for braking. Such braking may be accomplished exclusively and entirely by using the auxiliary braking system of this invention.

From the foregoing it may be seen that the apparatus of this invention provides for a braking system for a personal watercraft and, more particularly, to a braking system that operates independently of the steering system of the personal watercraft. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. A braking system for a personal watercraft, which watercraft includes a hull having a transom located proximate the stern thereof and a jet nozzle that directs propulsive water flow rearwardly of the transom to drive the watercraft forwardly, the nozzle being directionally adjustable by operator controls independently of said braking system for steering the watercraft; said braking system comprising:

at least one brake plate for mounting to the transom; said brake plate being alternatable between a nonbraking condition wherein said plate is retracted against the transom and held completely above a lower edge of the transom, and a braking condition wherein said brake plate extends beyond the lower edge of said transom; and a hand-controlled actuator assembly for selectively operating said brake plate to alternate said brake plate between said nonbraking and braking conditions, said brake plate being mountable to the transom such that the nozzle is directionally adjustable relative to the transom and independently of the operation of said brake plate.

2. The system of claim 1 wherein a pair of brake plates are mounted to the transom on respective sides of the jet nozzle.

3. The system of claim 2 in which said actuator includes at least one hand-controlled lever, an actuator cable assembly responsively interconnected to said hand-controlled lever and a linkage assembly for interconnecting said cable assembly and each brake plate and for driving said plates into said braking condition when said hand-controlled lever is operated.

4. The system of claim 2 wherein said brake plates are operated to simultaneously alternate between the braking and nonbraking condition and wherein each brake plate is for disposing on a respective side of the nozzle such that said brake plates perform braking exclusively in the extended position and do not perform steering of the watercraft.

5. The system of claim 3 in which each brake plate is mounted slidably in a respective support track that is securable to the transom.

6. The system of claim 5 in which each said plate includes a guide slot and said linkage includes a bearing movably interengaging said slot, and a fulcrum component carrying said bearing, said fulcrum component being pivotally mounted to said track and biased by a spring to pull said plate retractably into said nonbraking condition in said track, said linkage further including an actuator bar for interconnecting said fulcrum component and said cable and being longitudinally driven in response to operation of said hand-controlled lever to drive said fulcrum component pivotably against said spring and urge said plate to slide within said track into an extended, braking condition therein.

7. The system of claim 6 in which a single actuator bar interconnects a fulcrum component associated with a first one of said brake plates and a distinct fulcrum component associated with the other said brake plate, said bar being driven longitudinally by said cable in response to operation of said lever for pivotally pulling said first fulcrum component and pivotally pushing the other said fulcrum component to urge said plates to slide into the extended braking condition in said respective tracks.

8. The system of claim 1 in which said plate is mounted in a support track securable to the transom, said track including a base panel having a pair of inwardly turned lips formed along respective sides thereof, said lips defining vertical channels that receive said plate such that said plate flushly and slidably interengages said base panel.

9. A personal watercraft with independently controlled steering and braking systems, said watercraft comprising:

a hull having a transom located proximate the stern of said hull;

a jet nozzle for directing propulsive water flow rearwardly of said transom to drive the watercraft forwardly, said nozzle being directionally adjustable relative to said transom by operator controls for steering the watercraft;

a pair of brake plates for mounting to said transom on respective sides of said jet nozzle, said brake plates being simultaneously alternatable between a nonbraking condition wherein said plates are retracted against said transom and held completely above a lower edge of said transom and a braking condition wherein said plates extend beyond the lower edge of said transom; and a hand-controlled actuator assembly for selectively operating said brake plates to alternate between said braking and nonbraking conditions, said brake plates being attached to said transom such that said nozzle is directionally adjustable relative to said transom and independently of the operation of said brake plates.

10. The system of claim 9 in which said actuator includes at least one hand-controlled lever, an actuator cable assembly responsively interconnected to said hand-controlled lever and a linkage assembly for interconnecting said cable assembly and each brake plate and for driving said plates into said braking condition when said hand-controlled lever is operated.

11. The system of claim 10 in which each brake plate is mounted in a respective support track that is securable to the transom.

12. The system of claim 11 in which each said plate includes a guide slot and said linkage includes a bearing movably interengaging said slot, and a fulcrum component carrying said bearing, said fulcrum component being pivotally mounted to said track and biased by a spring to pull said plate retractably into said nonbraking condition in said track, said linkage further including an actuator bar for interconnecting said fulcrum component and said cable and being longitudinally driven in response to operation of said hand-controlled lever to drive said fulcrum component pivotably against said spring and urge said plate to slide within said track into an extended, braking condition therein.

13. The system of claim 12 in which a single actuator bar interconnects a fulcrum component associated with a first one of said brake plates and a distinct fulcrum component associated with the other said brake plate, said bar being driven longitudinally by said cable in response to operation of said lever for pivotally pulling said first fulcrum component and pivotally pushing the other said fulcrum component to urge said plates to slide into the extended braking condition in said respective tracks.

14. The system of claim 9 in which said operator controls include a control handle that is turned in a selected direction to direct said nozzle so that said nozzle propels the watercraft in the selected direction.

15. The system of claim 9 in which said brake plates are mounted to said transom on respective sides of an opening through which said nozzle is directed.

16. The system of claim 15 in which said brake plates perform braking exclusively and steering is performed exclusively by said nozzle.

17. A braking system for a personal watercraft, which watercraft includes a hull having a transom located proximate the stern thereof and a jet nozzle that directs propulsive water flow rearwardly of the transom to drive the watercraft forwardly, the nozzle being directionally adjustable by operator controls independently of said braking system for steering the watercraft; said braking system comprising:

at least one brake plate for mounting to the transom such that the nozzle is directionally adjustable independently thereof; said brake plate being alternatable between a nonbraking condition wherein said plate is retracted against the transom and held completely above a lower edge of the transom, and a braking condition wherein said brake plate extends beyond the lower edge of said transom, said brake plate being mounted in a support track securable to the transom, said track including a base panel having a pair of inwardly turned lips formed along respective sides thereof, said lips defining vertical channels that receive said plate such that said plate flushly and slidably interengages said base panel; and a hand-controlled actuator assembly for selectively alternating said brake plate between said nonbraking and braking conditions.

* * * * *